US006074013A

United States Patent [19]

Hsiao

[11] Patent Number: 6,074,013

[45] Date of Patent: Jun. 13, 2000

[54] CROSS MEMBER OF THE SEAT AND THE BACKREST OF A CHAIR

[76] Inventor: Yun-Chien Hsiao, No. 9, Lane 307, Sec. 2, Hai-Tien Rd., Tainan, Taiwan

[21] Appl. No.: 09/299,374

[22] Filed: Apr. 27, 1999

[51] Int. Cl.[7] ..... A47C 7/00

[52] U.S. Cl. ..... 297/440.1; 297/440.11; 297/452.63; 297/452.2

[58] Field of Search ..... 297/440.1, 440.11, 297/452.56, 452.63, 452.2

[56] References Cited

U.S. PATENT DOCUMENTS 2,695,050 11/1954 Quick ..... 297/440.11 X
3,512,834 5/1970 Lockshin ..... 297/440.11
4,438,800 3/1984 Hemmerle et al. ..... 297/440.11
4,456,301 6/1984 Apissomian ..... 297/440.11 X

*Primary Examiner*—Peter M. Cuomo
*Assistant Examiner*—Rodney B. White
*Attorney, Agent, or Firm*—Jackson Walker, LLP

[57] ABSTRACT

A cross member includes two end members each have a body with two passages, and an endless flexible member extending through the passages and connected between the two end members. Each body has a tab extending from the first end thereof so as to be riveted to the two sides of the seat frame and the backrest frame of the chair. A recess is defined in the first end of each body so as to receive the joint of the endless flexible member.

5 Claims, 5 Drawing Sheets

CROSS MEMBER OF THE SEAT AND THE BACKREST OF A CHAIR

FIELD OF THE INVENTION

The present invention relates to a cross member to be connected between two sides of the seat frame and the backrest frame of a chair. Each cross member is composed of multiple pairs of end members with a flexible member connected therebetween. The end members are fixedly connected to the two sides of the frame of the chair.

BACKGROUND OF THE INVENTION

A conventional chair made of metal tubes is conveniently manufactured and easily designed in various shapes so that the chairs can be used as leisure chairs. The seat and the backrest of the chair are made of a plastic or wooden board that is fixedly connected to the frames of metal tubes by rivets. Nevertheless, the plastic or wooden board cannot provide a good air exchanging feature between the body of the person sitting in the chair and the seat and the backrest so that the person will feel uncomfortable after sitting in the chair for a long period of time. Therefore, some manufacturers use flexible cross members such as endless strips to wrap between the two sides of the frame of the chair so as to form the seat and the backrest with holes defined therethrough. However, the flexible endless strips are difficult to secure between the two sides and it takes time to attach the endless strips one by one to the seat and the backrest.

The present invention provides an assembly of a cross member connected between the two sides of the seat frame and the backrest frame of a chair. The cross member includes two end members fixedly connected to the two sides of the frame of the seat and the backrest, and a flexible strip connected between the two end members.

The present invention resolves the drawbacks of the cross members of the conventional chair wherein the manufacturers only rivets the end members to the two sides of the seat frame and the backrest frame to form the backrest and the seat.

SUMMARY OF THE INVENTION

In accordance with one aspect of the present invention, a cross member is provided which comprises an end member respectively connected to the two sides of the seat frame and the backrest frame of a chair. Each end member has a body, and the first end of each body has a recess defined therein. Two passages are defined longitudinally through each body and communicate with the recess corresponding thereto. The second end of each body has two holes that communicate with the two passages corresponding thereto. An endless flexible member extends through the passages and is fixedly connected between the two end members. The two turning sections of the endless flexible member are respectively received in the two respective recesses of the two bodies.

The object of the present invention is to provide a cross member connected between the two sides of the seat frame and the backrest frame, wherein each cross member includes two end members with an endless flexible member connected between the two end members which are fixedly connected to the seat frame and the backrest frame.

Further objects, advantages, and features of the present invention will become apparent from the following detailed description with appropriate reference to the accompanying drawings.

DETAILED DESCRIPTION OF THE PREFERRED EMBODIMENTS

Figure 1:
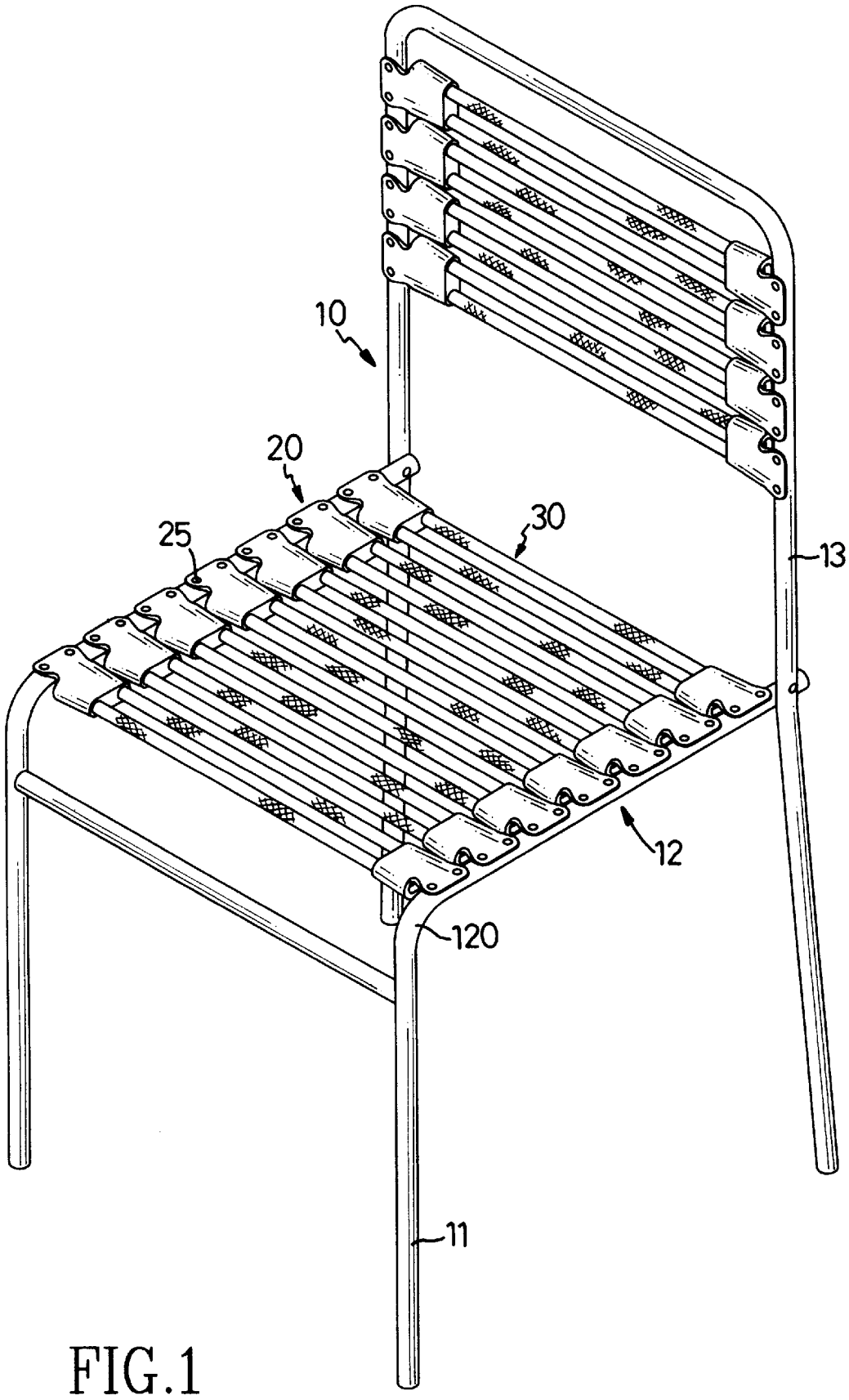
FIG 1 is a perspective view of a chair with multiple cross members in accordance with the present invention connected between the two sides of the seat frame and backrest frame.
Figure 2:
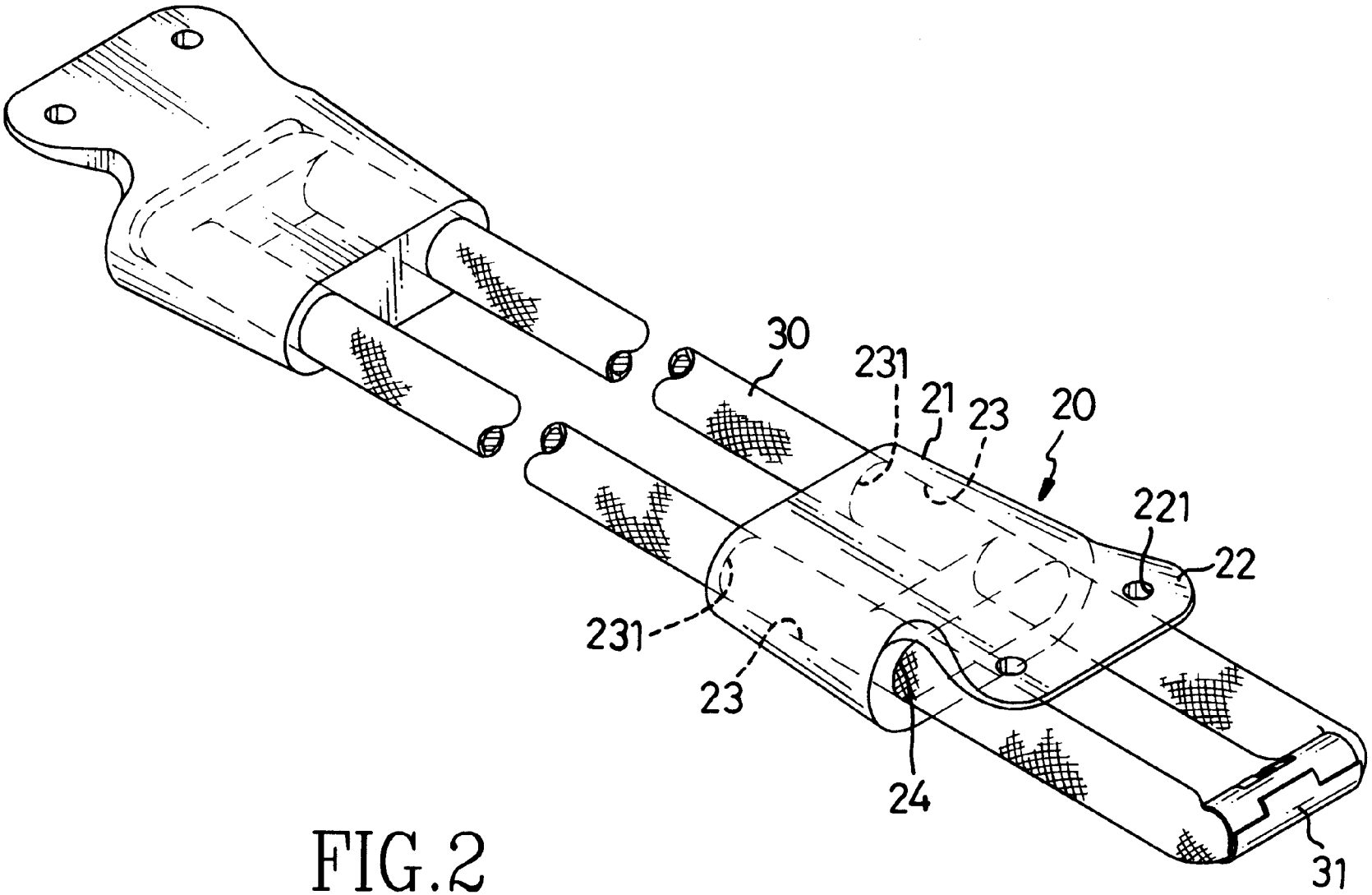
FIG. 2 is a perspective view of the cross member in accordance with the present invention.
Figure 4:
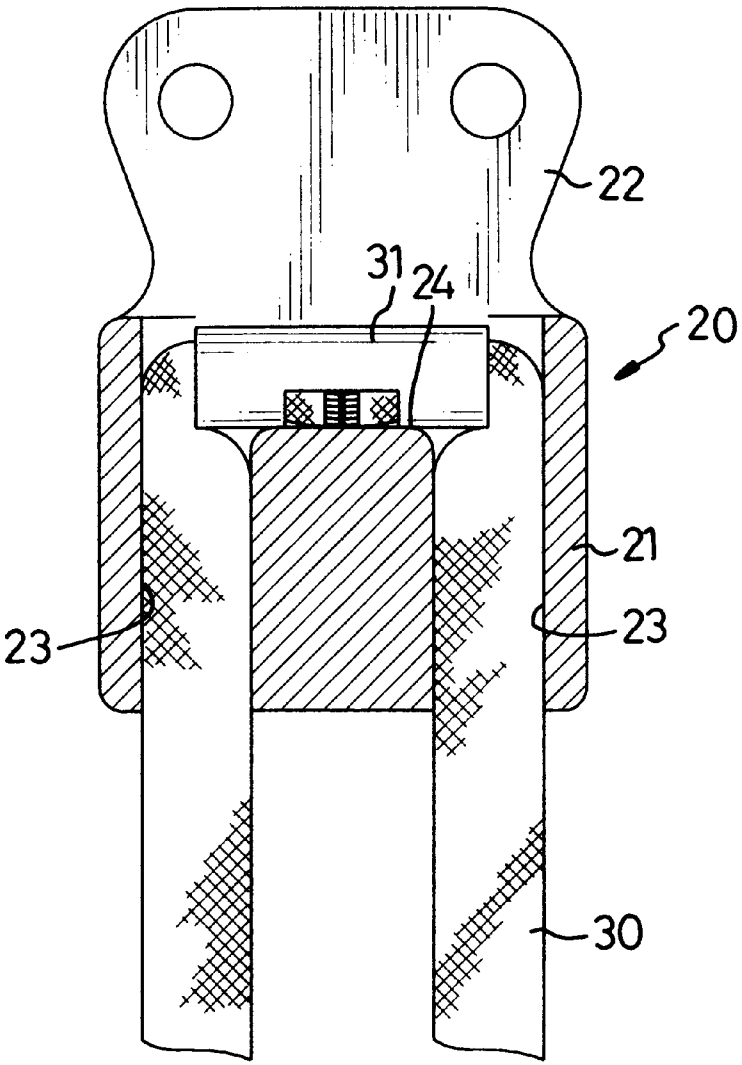
FIG. 4 is a top elevational view, partly in section, of the cross member in accordance with the present invention.
Figure 5:
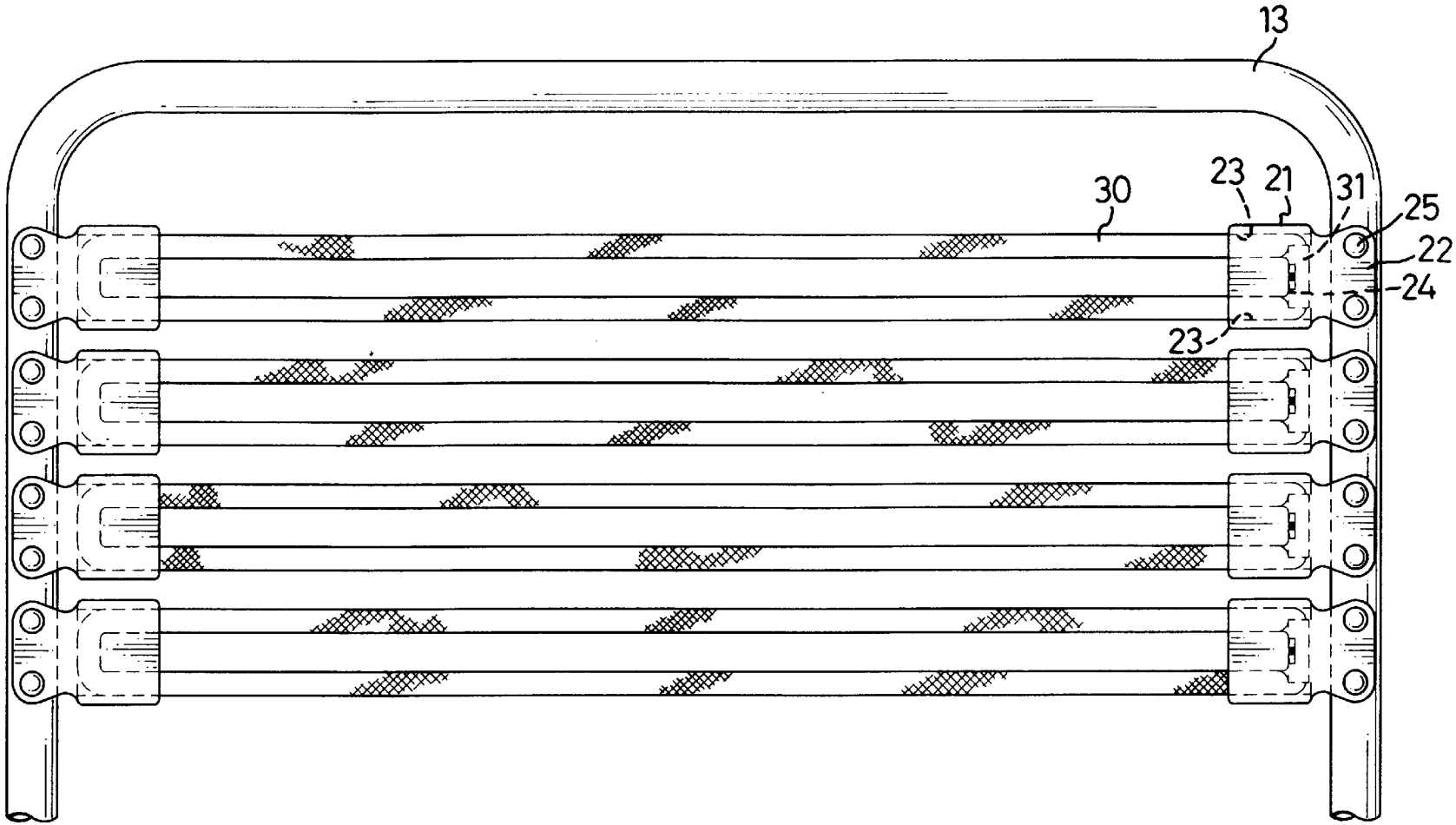
FIG. 5 is front plan view of four cross members in accordance with the present invention connected between the two sides of the backrest frame of a chair.

Referring to FIGS. 1, 2 and 4, a chair (10) comprises four legs (11), a seat frame (12) having two sides (120) integrally formed with the legs (11) and an inverted U-shaped backrest frame (13) connected to the seat frame (12). The cross member in accordance with the present invention comprises two end members (20) each having a body (21) and the first end of each body (21) has a recess (24) defined therein and a tab (22) that extends longitudinally from the first end of the body (21). Each tab (22) has two holes (221) defined therethrough so that the body (20) is fixedly connected to the corresponding side (120/13) by rivets (25) through the holes (221). Two passages (23) are defined longitudinally through each body (21) and communicate with the recess (24) corresponding thereto. The second end of each body (21) has two holes (231) that communicate with the two passages (23) corresponding thereto.

An endless flexible member (30) is formed by connecting two distal ends of a flexible strip together by a clamping member (31) which is made of metal plate and clamps the two distal ends of the flexible strip. The endless flexible member (30) extends through the passages (23) of the two end members (20) and the recess (24) of each body (21) receives the joint of the endless flexible member (30) therein so that the flexible member (30) will not protrude from the second end of the body (20).

According to the structure of the cross member of the present invention, the cross member can be prepared separate from the production of the frame of the chair. When assembling the chair (10), the assemblers simply rivet or screw the bodies (21) of the cross members to the seat frame (12) and the backrest frame (13). This will save assembly time.

Figure 3:
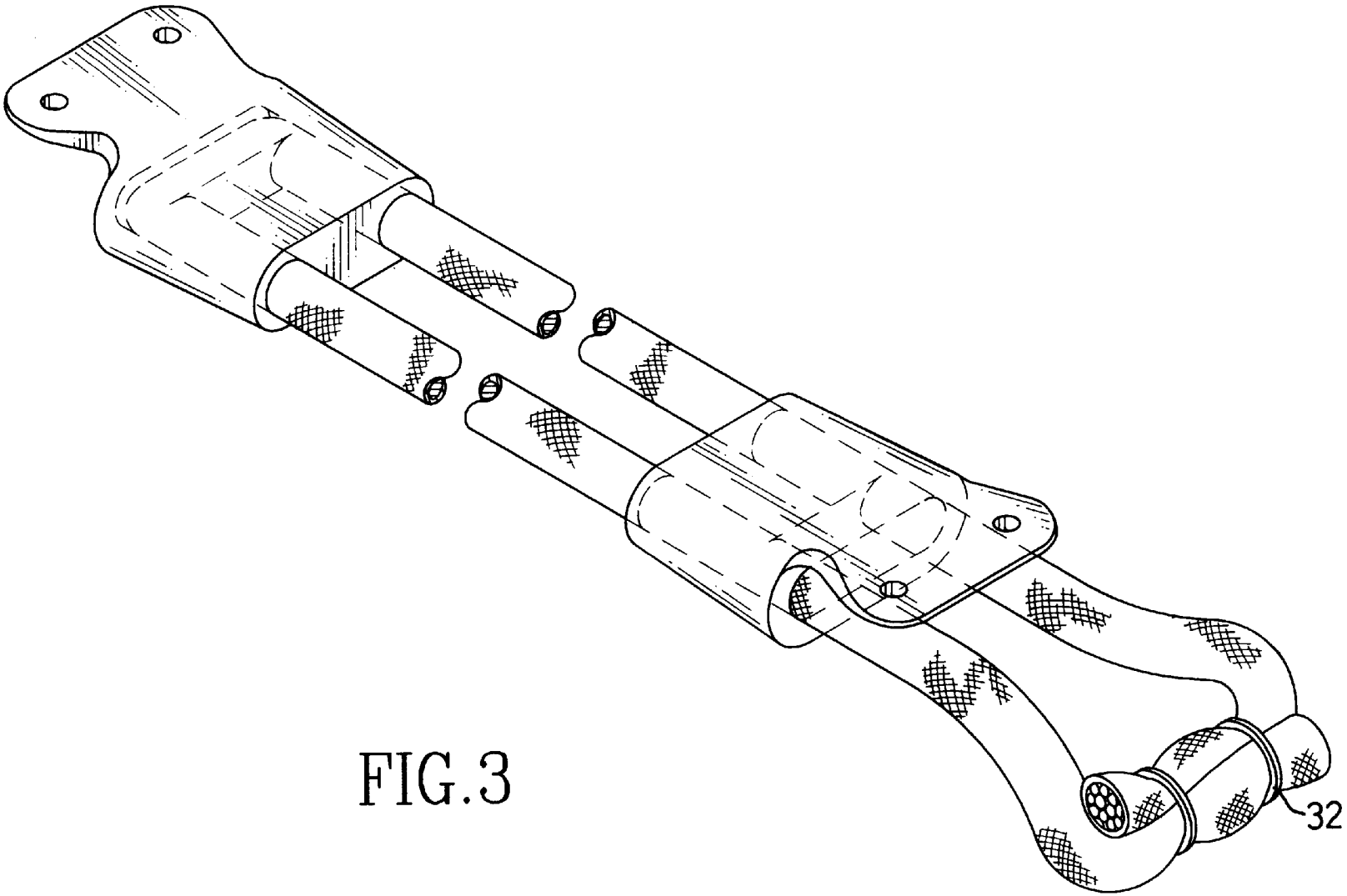
FIG. 3 is a perspective view of another embodiment of the cross member in accordance with the present invention.

FIG. 3 shows another embodiment of joining the two distal ends of the flexible strip. The two distal ends of the flexible strip are connected by two ties (32).

Although the invention has been explained in relation to its preferred embodiment, it is to be understood that many other possible modifications and variations can be made without departing from the spirit and scope of the invention as hereinafter claimed.

What is claimed is:

1. A cross member (20) of a chair (10) comprising four legs (11), a seat frame (12) connected to the legs (11) and a backrest frame (13) connected to the seat frame (12), said cross member (20) comprising:

two end members (20) adapted to be respectively connected to two sides of the seat frame (12) and the backrest frame (13), each end member (20) having a body (21) with a first and a second end, the first end of each body (21) having a recess (24) defined therein, two passages (23) defined longitudinally through each body (21) and communicating with said recess (24) corresponding thereto, the second end of each body (21) having two holes (25) which communicate with said two passages (23) corresponding thereto, and a flexible member (30) having two distal ends extending through said passages (23) of said two end members (20) and said recess (24) of each body (21) receiving a joint where the two distal ends of said flexible member (30) are joined together.

2. The cross member as claimed in claim 1, wherein each body (20) has a tab (22) extending longitudinally from the first end of said body (21) and each tab (22) has two holes (221) defined therethrough.

3. The cross member as claimed in claim 1, wherein said endless member (30) is formed by connecting two distal ends of a flexible strip together.

4. The cross member as claimed in claim 3, wherein said two distal ends of said flexible strip are connected by a clamping member (31).

5. The cross member as claimed in claim 3, wherein said two distal ends of said flexible strip are connected by at least one tie (32).

* * * * *